US011225632B1

(12) United States Patent
Wilshe

(10) Patent No.: US 11,225,632 B1
(45) **Date of Patent: *Jan. 18, 2022**

(54) CLEANING COMPOSITION FOR FACILITATING CLEANING SURFACES OF AN OBJECT USING FEMTOTECHNOLOGY

(71) Applicant: Donald Richard Wilshe, Parrish, FL (US)

(72) Inventor: Donald Richard Wilshe, Parrish, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/349,254

(22) Filed: Jun. 16, 2021

Related U.S. Application Data

(60) Provisional application No. 63/065,232, filed on Aug. 13, 2020.

(51) Int. Cl.

| | |
|---|---|
| ***C11D 3/48*** | (2006.01) |
| ***C11D 7/44*** | (2006.01) |
| ***C11D 11/00*** | (2006.01) |
| ***C11D 7/50*** | (2006.01) |

(52) U.S. Cl.
CPC ..... *C11D 7/44* (2013.01); *C11D 7/5022* (2013.01); *C11D 11/0041* (2013.01)

(58) Field of Classification Search
CPC ..... C11D 7/22; C11D 3/48
USPC ..... 510/337
See application file for complete search history.

(56) References Cited

U.S. PATENT DOCUMENTS

| | | | | |
|---|---|---|---|---|
| 3,124,618 | A | 3/1964 | Berry | |
| 3,551,339 | A | 12/1970 | Quimby | |
| 3,590,035 | A | 6/1971 | Damico | |
| 3,773,770 | A | 11/1973 | Damico | |
| 10,994,999 | B1 * | 5/2021 | Wilshe | C05G 3/80 |
| 11,000,541 | B1 * | 5/2021 | Wilshe | A61P 31/04 |
| 2010/0062958 | A1 | 3/2010 | Bertram | |

* cited by examiner

*Primary Examiner* — Gregory E Webb

(57) ABSTRACT

Disclosed herein is a cleaning composition for facilitating cleaning surfaces of an object, in accordance with some embodiments. Accordingly, the cleaning composition may include carbanions and a diluting agent. Further, a carbanion of the carbanions may include a carbon atom. Further, the carbon atom may include a formal charge of −1. Further, the diluting agent may be capable of combining with the carbanions for forming at least one appliable form of the cleaning composition. Further, a ratio of the diluting agent to the carbanions by volume may be 64:1. Further, the combining facilitates applying of the at least one appliable form of the cleaning composition to at least one surface of the object. Further, the applying of the at least one appliable form of the cleaning composition cleans at least one contaminant present on the at least one surface of the object.

20 Claims, 7 Drawing Sheets

CLEANING COMPOSITION FOR FACILITATING CLEANING SURFACES OF AN OBJECT USING FEMTOTECHNOLOGY

The current application claims a priority to the U.S. Provisional Patent application Ser. No. 63/065,232 filed on Aug. 13, 2020.

FIELD OF THE INVENTION

Generally, the present disclosure relates to the field of cleaning compositions for solid surfaces, auxiliary compositions therefor, or processes of preparing the compositions. More specifically, the present disclosure relates to a cleaning composition for facilitating cleaning surfaces of an object using femtotechnology.

BACKGROUND OF THE INVENTION

Existing compositions for facilitating cleaning surfaces of an object are deficient with regard to several aspects. For instance, existing compositions do not include carbanions. Furthermore, current compositions do not include plant-derived carbanions.

Therefore, there is a need for a cleaning composition for facilitating cleaning surfaces of an object using femtotechnology that may overcome one or more of the above-mentioned problems and/or limitations.

SUMMARY OF THE INVENTION

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

Disclosed herein is a cleaning composition for facilitating cleaning surfaces of an object using femtotechnology, in accordance with some embodiments. Accordingly, the cleaning composition may include carbanions and a diluting agent. Further, a carbanion of the carbanions may include a carbon atom. Further, the carbon atom may include a formal charge of −1. Further, the diluting agent may be capable of combining with the carbanions for forming at least one appliable form of the cleaning composition. Further, a ratio of the diluting agent to the carbanions by volume may be 64:1. Further, the combining facilitates applying of the at least one appliable form of the cleaning composition to at least one surface of the object. Further, the applying of the at least one appliable form of the cleaning composition cleans at least one contaminant present on the at least one surface of the object.

Further disclosed herein is a method for producing a cleaning composition to facilitate cleaning surfaces of an object, in accordance with some embodiments. Accordingly, the method may include a step of extracting at least one organic material from at least one organic material source. Further, the at least one organic material may include carbon atoms. Further, the at least one organic material may include a carbon compound. Further, the method may include a step of blending the at least one organic material with at least one reagent for forming a composition preform. Further, the method may include a step of applying at least one of a specific temperature and a specific pressure to the composition preform. Further, the applying initiates a chemical reaction in the composition preform. Further, the chemical reaction may include at least one of a redox reaction and a reduction reaction. Further, the carbon atoms may be reduced to form carbanions based on the at least one of the redox reaction and the reduction reaction. Further, a carbon atom of the carbanions may include a formal charge of −1. Further, the method may include a step of combining the carbanions with a diluting agent for forming at least one appliable form of the cleaning composition. Further, a ratio of the diluting agent to the carbanions by volume may be 64:1. Further, the combining facilitates applying of the at least one appliable form of the cleaning composition to at least one surface of the object. Further, the applying of the at least one appliable form of the cleaning composition cleans at least one contaminant present on the at least one surface of the object.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAIL DESCRIPTIONS OF THE INVENTION

Figure 1:
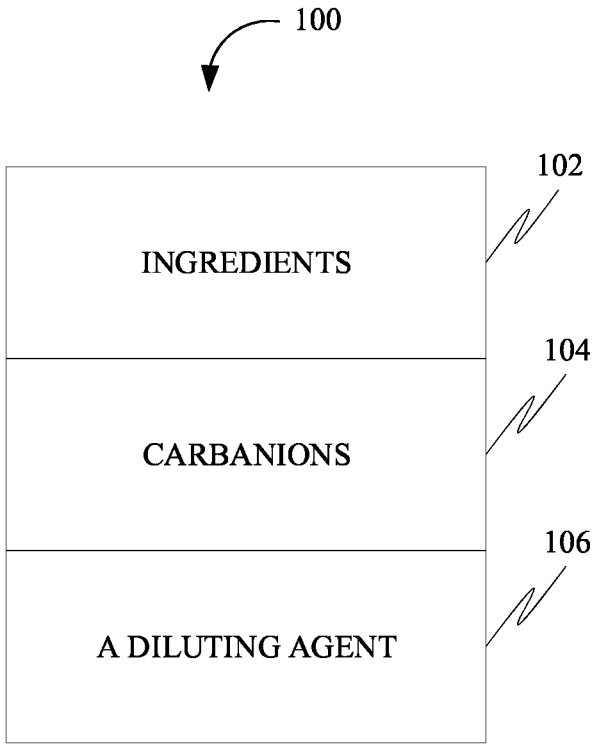
FIG. 1 is a table listing ingredients of cleaning composition for facilitating cleaning surfaces of an object using femtotechnology, in accordance with some embodiments.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim limitation found herein and/or issuing here from that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the claims found herein and/or issuing here from. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of a cleaning composition for facilitating cleaning surfaces of an object using femtotechnology, embodiments of the present disclosure are not limited to use only in this context.

Overview:

The present disclosure describes a cleaning composition for facilitating cleaning surfaces of an object using femtotechnology. Further, the cleaning composition may include carbanions. Further, the carbanions may include negatively charged carbon atoms. Further, the negatively charged carbon atoms may be created by making use of the physical chemistry of the carbanions. Further, the physical chemistry may be the study of macroscopic, atomic, subatomic, and particulate phenomena in chemical systems in terms of the principles, practices, and concepts of physics such as motion, energy, force, time, thermodynamics, quantum chemistry, statistical mechanics, analytical dynamics and chemical equilibrium.

Physical chemistry is the study of how matter behaves on a molecular and atomic level and how chemical reactions occur. Based on the analyses, physical chemists may develop new theories, such as how complex structures are formed. Physical chemists often work closely with materials scientists to research and develop potential uses for new materials.

Further, the physical chemistry may be used in observing the assembly of molecules and determining, measuring, and quantifying the assembly of the molecules. Further, the physical chemistry may allow for assembling of molecules in crystals and solutions and observing and measuring of the arrangements of atoms and molecules and aggregates of the atoms and the molecules in the solutions as well as in crystals and various properties the aggregates of surfactants impart to a product. Further, diffraction, infrared, and microscopy methods are used for observing the assembly of the molecules and determining, measuring, and quantify the assembly of the molecules. Further, the physical chemistry may be used for developing better ways to measure and quantitate aspects of the ingredients for developing better products.

Physical chemistry provides an understanding of the physical properties of atoms and molecules, the way chemical reactions work, and what these properties reveal. Further, the physical chemistry involves analyzing materials, developing methods to test and characterize the properties of materials, developing theories about these properties, and discovering the potential use of the materials. Using sophisticated instrumentation and equipment has always been an important aspect of physical chemistry. Most physical chemistry labs are full of analytical instruments, which may include lasers, mass spectrometers, nuclear magnetic resonance, and electron microscopes.

Physical chemistry may provide an understanding of chemical properties and describes the behavior of chemicals using theories of physics and mathematical computations. Further, the properties and reactions of the chemicals may be predicted using the physical chemistry.

Physical chemistry provides fundamental physical characteristics of material be it solid, liquid, or gas.

Further, the physical chemistry may be used for the development of materials, including plastics, ceramics, catalysis, electronics, fuel, batteries, surfactants and colloids, and personal care products.

Further, the carbanions may be created using pico-technology. Further, pico-technology may be described as involving the alteration of the structure and the chemical properties of individual atoms through the manipulation of energy states of electrons within the individual atoms to produce states with unusual properties, producing some form of exotic atoms. Further, the pico-technology may be used in the fabrication of structures where atoms and devices may be positioned with sub-nanometer accuracy. This may be important where interaction with a single atom or molecule may be desired.

Further, the carbanions may individual atoms or atoms in covalent bonds. Further, the individual atoms alone or the atoms in the covalent bonds may create powerful electromechanical reactions to disassemble organic material, one atom per atom at a time. Further, the individual atoms alone or the atoms in the covalent bond may work on the fungi, the bacteria, or the viruses to eliminate the fungi, the bacteria, or the viruses. Further, the individual atoms alone or the atoms in the covalent bond may eliminate Shingles, Basil Cell Cancer, Squamous Cell Cancer, Poison Ivy, Oak, Sumac, Diabetic Ulcers, Wounds, Plaque Psoriasis, Genetic Blistering, Head lice, and Whopping Cough of humans. Further, the individual atoms alone or the atoms in the covalent bond may regenerate or grow the skins on the humans.

Further, the carbanions may attack pests at the atom level. Further, at the atom level, the shield of the pests starts to disassemble eliminating the shield and killing the pests.

Further, the pico-technology may be used for altering electron distributions around atoms to promote surface energy to achieve inhibited infection without potential nanomaterial toxicity concerns. Further, the pico-technology may be used to describe the control of electron distribution around the atoms to provide desirable properties. Further, the control of the electron distribution may greatly change surface energy and, thus, the way that proteins adsorb onto a material. Further, the excitement or rearrangement of electrons around the atoms may influence many cellular functions including cell movement, intracellular transport to organelles, adhesion, growth, and ECM formation.

Further, the pico-technology may be used for altering electron distributions around atoms to promote surface energy to achieve similar increased tissue growth, decreased inflammation, and inhibited infection without potential nanomaterial toxicity concerns. A potentially less toxic method that is used to increase tissue growth and create the next generation of tissue engineering materials is to use pico-technology. Further, pico-technology may be used to control the electron distribution around atoms, so as to provide desirable properties. Having control over electron distribution may greatly change surface energy and, thus, the way that proteins adsorb onto a material. Therefore, through the excitement or rearrangement of electrons around atoms, one has the ability to influence many cellular functions including cell movement, intracellular transport to organelles, adhesion, growth, and ECM formation.

Further, the pico-technology may control cellular microtubules (MTs). MTs s are cylindrical cellular formations 25 nm in diameter, and they are made out of tubulins. Dynamic instability due to MT plus end-binding proteins also called "plus end-tracking proteins", are able to "surf" the dynamic ends of MTs. Further, when tips are expressed as green fluorescent proteins, the fluorescence is the brightest at the MT and decreases in intensity toward the minus end of the MT, forming a comet tail. Further, external stimulation is used to excite the MT and end-binding proteins to promote the movement of cells using the pico-technology. This may be a less toxic manner through which to alter surface energy to increase tissue growth since electron distributions may be changed for numerous macro-, micro-, or nanomaterials. Further, the pico-technology may be used to reduce the toxicity in any macro-, micro-, or nanomaterials by exciting electrons. The change in electron distribution, along with the associated charge redistribution, may alter surface energetics to change the adsorption of certain proteins (as well as cellular functions).

Further, the carbanions may include carbon atoms. Further, the carbon atoms may be associated with CO2 (carbon dioxide) gas. Further, an average person breathes out around 500 liters of the greenhouse gas CO2, which amounts to around 1 kg or 2.3 pounds of mass. Further, the world's population is around 6.8 billion, collectively breathing out around 2500 million tons of CO2, which is around 7 percent of the annual CO2 tonnage churned out by the burning of fossil fuel around the world. Further, the CO2 breath out by the average person may be a part of a natural cycle, by which the body of the average person may convert carbohydrates from CO2-absorbing plants into energy, plus water and CO2. Further, the carbanions may include a Pico-19 product. Further, the Pico-19 product may be made of carbon atoms from CO2. Further, the average person may breathe the carbon atoms of the CO2 and consume the carbon atoms of vegetables of plants. Further, the body of the average person may include 50% carbon as the average person consumes the plant.

Further, electrons are used to make the carbon atoms of the carbanions negatively charged and the carbanions do not have a no-charge carbon atom. That makes the carbanions a 10 to 15th cleaner. Further, the carbanions applications are for water, soils, and molecule to atom product or a molecule splitter.

Further, the carbanions may be used to make pico products. Further, the pico products may include a "PicoMed". Further, the "PicoMed" may control Bacteria, Insects, Fungi, and viruses. Further, the "PicoMed" may be created using Pico technology.

Further, the "PicoMed" pesticide qualifies as a Biopesticide, Biostimulant, Biofertilizer, and Biologicals.

Further, the "PicoMed" may be used for the elimination of vital elements in Bacteria, Insects, Fungi, and viruses.

Further, the "PicoMed" is configured for eliminating the cell membrane of the bacteria and puncturing the cell membrane. Further, the eliminating and the puncturing of the cell membrane may drain proteins and lipids from the bacteria.

Further, the "PicoMed" is configured for eliminating the cellulose and chitin of the fungus.

Further, the "PicoMed" is configured for eliminating strands of a nucleic acid of the virus, either DNA or RNA of the virus, and protective protein coat of the virus (the capsid), or a lipid envelope of the virus, surrounding the protein of the virus.

Further, the "PicoMed" is configured for eliminating or penetrating and dissolve lipid cellular membranes of the insects, cells desiccation of the insects, cellular metabolism of the insects, dissolving cuticles of the insects, lubrication joints of the insects leading to paralysis, stripping the pests protective shields of the insects, exoskeleton structure of the insects, chitin and protein substances of the insects, hydrocarbon chains smothering of the insects.

Further, the "PicoMed" immediately impacts the exoskeleton structure of the pest upon contact by disrupting the molecular structure of the chitin and other protein substances that protect the insect. This mechanism of action triggers the rapid and irreversible deterioration of the insect's spiracles and tracheal system, resulting in suffocation. Further, the "PicoMed" kills insects with the elimination of chitin. Further, chitin is a polysaccharide and a carbohydrate that has a chain of sugar molecules. Further, chitin has a structure like cellulose. Additionally, the chitin may be present in the exoskeletons of the insects.

Further, the "PicoMed" benefit from the revolutionary method of insect control with an absence of undesirable side effects on human health and no harm to the ecosystem. Additionally, unlike standard insecticides in use today, no built-in resistance may be developed by the targeted insects, but rather on the respirators apparatus.

Further, the "PicoMed" may be mechanical in primary sequential steps. Further, a first step is a direct interaction between the surface and the outer membrane of the pests, causing the membrane to rupture and leak fluids, proteins, and nutrients.

Lastly, in a few more ways, the "PicoMed" electromechanical may affect the pests:

- There may be a second step related to the holes in the outer membrane, through which the pests lose vital nutrients, protein, water, and components, causing a general weakening of the pests.
- Electromechanical may affect pests by penetration and dissolving of lipid cellular membranes.
- This causes cell desiccation to leak water, proteins, and nutrients and collapse.
- By interfering with cellular metabolism during metamorphosis.
- By dissolving cuticles, the lubrication in the insect and joints of the insects leading to paralysis.
- By stripping the pests' protective shields (wax, biofilm, etc), rendering the pests defenseless against subsequent treatment.
- The extracts impact the exoskeleton structure of the pests upon contact by disrupting the molecular structure of the chitin and other protein substances that protect the insect.
- The extracts may have the ability to penetrate complex hydrocarbon chains and disintegrate the insects.
- The extracts may emulsify the pests thus stopping the reproduction cycle.
- The change in the environment for growth with PH from acidophils and neutrophils to alkaliphiles.

Further, the "PicoMed" may be configured for punching holes in a cell of the pests. Further, the punching holes in the cell breaching the cell's main defense. Further, an unopposed stream of the "PicoMed" enters the cell. This puts several vital processes inside the cell in danger. Further, the "PicoMed" overwhelms the inside of the cell and obstructs cell metabolism (i.e., the biochemical reactions needed for life) Further, the "PicoMed" binds to enzymes of the cell halting the activity of the cell. Further, the pests no longer "breathe", "eat", "digest", "reproduce" or "exist".

Further, an outer membrane of the cell, including that of a single cell organism like pests, is characterized by a stable electrical micro-current. This is often called "transmembrane potential", and is literally, a voltage difference between the inside and the outside of a cell It is strongly suspected that when a pest comes in contact with the "PicoMed", short-circuiting of the current in the cell membrane may occur. Further, the current weakens the outer membrane and creates holes, and leak water, proteins, and nutrients from the cell.

Further, the "PicoMed" effect fast, and affects such a wide range of pests.

The experiences observed explain the speed with which pests and other pests perish on "PicoMed" surfaces by the multi-targeted effects. After membrane perforation, may inhibit any given enzyme that "stands in its way," and stop the ceil from transporting or digesting nutrients, from repairing its damaged membrane, from breathing or multiplying Harmless to Environment Air, Water, Soil, Humans, Birds, and Animals This has no side effects or harm on human, birds and animal health. These solutions do not harm mammal cells nor the solutions attack the neurological systems of humans, birds, and animals. Further, the "PicoMed" may lyse cells to extract protein or organelles, or to permeabilize the membranes of living cells.

The organic product dissolves lipids from cell membranes making the cell membranes permeable to antibodies. Because the organic solvents also coagulate proteins, the organic product may be used to fix and permeabilize cells at the same time. Saponin interacts with membrane cholesterol, selectively removing it and leaving holes in the membrane. Permeabilization is the process of making something, such as a membrane or cell wall, permeable. Lyse is a verb referring to the process of lysis, the death of a cell. Lysis refers to the breaking down of the membrane of a cell, often by viral, enzymic, or osmotic mechanisms that compromise cell integrity. A fluid containing the contents of lysed cells is called a lysate. In molecular biology, biochemistry, and cell biology laboratories, cell cultures may be subjected to lysis in the process of purifying the components, as in protein purification, DNA extraction, RNA extraction, or purifying organelles.

Trophobiosis Cycle: Pests shun healthy plants Pesticides weaken plants. Weakened plants open the door to pests and disease. Further, the pesticides precipitate pest attack and disease susceptibility, and thus the pesticides induce a cycle of further pesticide use.

Further, the carbanions may be created using Femto-technology. Further, the Femto-technology may be used for creating carbanion of the 8-octet, 9-nonet, 10-dectet, 11-undectet, and 12-duodectet by electrons addition. Further, the Femto-technology may be used for matter manipulation for modifying a carbon atom of the carbanions.

Further, the present disclosure describes a composition comprising carbanions. Further, the carbanions are created using picotechnology and/or femtotechnology. Further, the picotechnology and/or femtotechnology works atom to atom for mechanical disassembly of viruses, Bacteria, Insects, and Fungi control. Further, a single drop of the composition may include 5 sextillion negatively charged carbon atoms. Further, the negatively charged carbon atoms restrict viruses' elemental mode of action by eliminating strands of nucleic acid, either DNA or RNA, and a protective protein coat (the capsid), or a lipid envelope, surrounding the protein of the viruses.

Further, the carbon atom may be manipulated using temperature or pressure for modifying the carbon atom to make a carbanion. Electron addition can be 8-octet, 9-nonet, 10-dectet, 11-undectet, and 12-duodectet.

Further, the carbon atom is a lethal killer of bacteria, fungi, viruses, or small insects.

Further, the pico-technology may allow using of atoms singularly. Further, the carbanions may be formed by collecting 1 to 3 atoms of the periodic table. Further, 1 to 3 atoms may be bonded together to eliminate the fungi, the bacteria, or the viruses.

Further, pico-products comprising the carbanions may have the following characteristics:

1). No harm to air (no GWC, ODC, VOHAP, or VOC) soils or waters.

2). Can not be made of organic chemistry, graphene, or nanotechnology, just single atom pico technology or physical chemistry 3). Goals are primary distribution as an OTC product.

4). It must be made of atomic elements and not molecules.

5). Must be able to kill all pests, be it bacteria, fungi, viruses, and insects.

6). Must be able to deep clean and grow skin and heal wounds just days not weeks 7). Must be able to penetrate the shields of all pests.

8). Must be approved at the State and or Federal FDA or better be exempt.

9). Must be safe for humans, bees, birds, and animals—zero side effects.

10). Must be made of 100% new organic carbon.

11). No Chemicals

12). No Biologicals

13). No Nanotechnology

14). No Graphene

15). No Molecules

16). Eliminate Sickness

Further, the pico-products facilitate Soil and Ground Water Remediation. Further, the pico-products may form Physical Chemistry At 600 Picometers or 2 Atoms Size. Further, the pico-products may 89% Biobased Content. Further, the pico-products may include ingredients such as EAFUS: A Food Additives. Further, the pico-products may not include hazardous Canadian Heavy 11 Metal. Further, the pico-products particle size provides trans-location and remediation. Further, the pico-products may restructure water, and spray rig pressure drops by 19%. Further, the pico-products may increase Brix levels from 100% to 200%. Further, the pico-products may provide Electrical Conductivity (EC) (Microsiemens). Further, the pico-products may increase carbon dioxide consumption. Further, the pico-products may increases ERGS by 2000%. Further, the pico-products may increase Corn, Soybeans, Wheat, Oats Alfalfa production. Further, the pico-products may provide a spray rig cleaning benefit. Further, the pico-products may provide wind resistance benefits. Further, the pico-products may provide late planting benefits. Further, the pico-products may provide frost resistance. Further, the pico-products may increases 269% Brix in macadamia benefit. Further, the pico-products may stimulate crop production factors. Further, the pico-products don't affect good bacteria. Further, the pico-products may achieve "increasing carbon dioxide consumption". Further, the pico-products may be used as seed wash, germ test 85% untreated to 98% treated. Further, the pico-products may provide tank mixing, water restructuring, lower dynes from 70 to 30. Further, the pico-products may be used for both organic fertilizer & organic pesticides. Further, the pico-products may not pose any health hazards signage to workers, customers, or owners. Further, the pico-products may not require the posting of warnings signs anymore posted to protect customers or workers when spraying or applying the pico-product. Further, the pico-products may not pose any concerns about toxic chemical sprays drifting into neighborhoods or runoff into water or air supply. Further, the pico-products may not pose any concerns over issues associated with registered pesticides when spraying. Further, the pico-products may not require a protected storage area or special handling of dangerous chemicals. Further, the pico-products may not require any special handling, transportation, or equipment. Further, the pico-products may not pose any threat or concern over fees and fines levied by OSHA guidelines. Further, the pico-products may not pose any threats of violating "toxic chemical libel laws" for applying more or the wrong pesticide than direct by poisonous product instructions. Further, the pico-products may not require any hazardous waste disposal requirements to follow. Further, the pico-products may not invite workmen's compensation claims or lawsuits from customers or workers claiming insecticide exposure. Further, the pico-products may not invite workers' compensation fees charged after receiving a waiver for reducing or eliminating pesticides and toxic cleaners. Further, the pico-products may not provide any liability for pollution mitigated for land sales, no cleanup of pesticides. Further, the pico-products may not require closing because of spraying as now you have a zero re-entry time product. Further, the pico-products may not require any additional labor or costs required for associated spraying and handling. Further, the pico-products may provide a "poison-free" working environment by replacing dangerous fungicides and insecticides, in multiple forms, plus degreaser, toxic detergents, numerous cleaners, and solvents. Further, the pico-products may be self-cleans equipment applicators and reduces equipment maintenance costs. Further, the pico-products may reduce pesticide and chemical costs by up to 75%. Further, the pico-products may enhance plant root growth and nourishment by breaking the surface tension of water for deeper and more rapid soil penetration. Further, the pico-products may increases product yields from 105% to 300%. Further, the pico-products may appear to strengthen the plant, which provides stronger blooms and increases systemic acquired resistance, defending plants from insects and fungus. Further, the pico-products may increase plant growth by 10% to 300% over a 3-month period of time for starter plants. Further, the pico-products may save $3,000 to $5,000 annually by reducing discarded plants on a nursery. Further, the pico-products may be a non-toxic product that can be recommended and sold to customers and other growers. Further, the pico-products provide increased peace of mind about crop success and non-poisonous operations at reduced costs. Further, the pico-products may facilitate faster crop production more turnover of crops in fields and greenhouses. Further, the pico-products may facilitate a 15% increase in greenhouses and possibly a 100% increase in annual field production by growing an extra crop per annum. Further, faster crops mean less borrowing costs on crop loans. Further, the pico-products may be alternated, rotated, or mixed with chemicals to lower costs and reduce environmental pollution and worker safety. Further, the pico-products may be used for washing hands, cleaning tools therefore not spreading diseases from plant to plant or tree to tree or human to customer. Further, 120-day rice crops grown in 100 days with up to 45% yield increase, 120-day onion crop grown in 90 days with 30% more products based on an application of the pico-products. Further, the pico-products may increase the quality of grains and nutrients of crops grown. Further, the pico-products may decrease the plum harvest rejection rate from 65% to only 35%. Further, the quality of fruit and skin now meets the shipping standards. Further, the pico-products may is made from 100% US GOV food and drug administration (FDA) EAFUS food additives. Further, the pico-products may is defined as food by the FDA. Further, the pico-products may improve the plant's electro-mechanical function, which enables cells to communicate more efficiently and be more productive. Further, the pico-products that may increase plant Brix/sugar levels by up to 100% have been recorded. Further, the pico-products may be used to supply nutrients to seeds that encourage germination and vigorous growth. Further, plants sprayed with the pic-product reduce co2 from the atmosphere by up to 33% by increasing plant sugar levels in the photosynthesis process. Further, the pico-products may produce potential benefits such as claimed carbon credits that help to reduce the price of pico-products. Further, the pico-products may be nontoxic, non-hazardous, cost-effective, and humanly safe. Further, the pico-products may reduce hunger, starvation, and poverty with increased production.

Further, a pico-product may facilitate skin clearing and cure psoriasis. Further, the pico-product may heal painful lesions. Further, the pico-product may heal lesions, lumps, and specks. Further, the pico-product may decrease skin infections decreased. Further, the pico-product may reduce black specs to surface and lesions. Further, the pico-product may lessen the sub-dermal skin movement. Further, the pico-product may lessen itching, pricking on toes, hands, fingers, skin. Further, the pico-product reduces crawling and itching, moisturizes skin, and heals sores. Further, the pico-product reduces sting and itching. Further, the pico-product removes pimples on the chin. Further, the pico-product is a great household cleaner for everything Further, the pico-product is used for lesions, mouth gargle, white specs, grains. Further, the pico-product stops glass itching, biting. Further, the pico-product provides smooth skin, erases wrinkles, and provides sub-dermal extraction. Further, the pico-product reduces itching and biting. Further, the pico-product provides silky soft skin. Further, the pico-product is used as makeup. Further, the pico-product reduces welt type sores suffering and itching. Further, the pico-product reduces crawling and biting. Further, the pico-product helps get rid of a cold and improve lung functioning. Further, the pico-product generates fibers from the body. Further, the pico-product dislodges sub-dermal foreign non-organism materials. Further, the pico-product provides fiber extrusion and stops itching. Further, the pico-product reduces Lyme's disease, candida, and hypothyroidism. Further, the pico-product reduces lesions and provides skin softening. Further, the pico-product provides lesion management. Further, the pico-product reduces chronic lesions. Further, the pico-product reduces lesions, healing, itching, and acne-like cysts. Further, the pico-product sloughs off dead skin. Further, the pico-product may normalize diabetic skin on the legs and prevent amputations. Further, the pico-product reduces crawling or stinging. Further, the pico-product helps with Lyme's, fibromyalgia, molds, and fungal. Further, the pico-product fades red scars, removes fibers, and provides smooth skin and normal skin. Further, the pico-product helps with deworming. Further, the pico-product heals painful lesions, provides deep sub-dermal extraction, and reduces skin cancer. Further, the pico-product moisturizes the skin. Further, the pico-product removes critters on the face. Further, the pico-product helps with pricking and eyes. Further, the pico-product may be used for brushing teeth and breathing fresh. Further, the pico-product heals the foot. Further, the pico-product provides foot care and removes discoloration and scars. Further, the pico-product reduces dandruff, shards of dead white skin, itch flakes, and bleeding, Further, the pico-product reduces eczema. Further, the pico-product helps with psoriasis, alligator skin, scabs, and nail fungus. Further, the pico-product provides hair conditioning. Further, the pico-product reduces candida and fibroid-like lumps in the flesh. Further, the pico-product eliminates organism shedding black particles and an itchy patch. Further, the pico-product provides bath soaking for organism shedding, organism release, itchy biting, black particles, itchy patch, parasites, and bacterial infections. Further, the pico-product reduces scabbing, scar tissue, and hard callouses. Further, the pico-product reduces groin heat rash, eczema ear canal, poison ivy, laundry stains, fungus, mildew, and center back itch. Further, the pico-product reduces scalp and eyelids clumps/fuzz balls, black fibers, and black specs. Further, the pico-product may prevent head sores. Further, the pico-product may be used as the liquid for bath, cream for hands, feet, and head. Further, the pico-product reduces lesions. Further, the pico-product may be used for nasal spray and enemas. Further, the pico-product may prevent Lyme disease, creepy-crawly sensations, headache, fatigue, hair loss, chest pain, and bumps/lesions scalp. Further, the pico-product calms and soothes the itch of bacteria and Lyme rash. Further, the pico-product prevents dental infections in molar and yeast infections. Further, the pico-product heals skin lesions faster. Further, the pico-product cleans skins, deep pathogens, Further, the pico-product reveres skin tan.

Further, the pico-product may include Picosoap Muratic Acid Replacement, Picosoap Acetone Replacement, and Picosoap Chlorine Replacement.

Further, the pico-product may include products such as Picosoap Acid Cleaner, Picosoap Adhesive, Mastic, Caulk Remover, Picosoap Adult Shampoo, Picosoap Adult Soaps, Picosoap Aircraft, and Metal Cleaner, Picosoap Alkaline Cleaner, Picosoap All-Purpose Cleaner, Picosoap Anti-Allergen Additive, Picosoap Aqueous Cleaner Concentrate, Picosoap Asphalt equip. cleaner, Picosoap Automobile/Truck/RV Cleaner, Picosoap Bath & Body Wash, Picosoap Bath & shower gels, Picosoap Bathroom Cleaner, Picosoap Biosolvents for oil spills, Picosoap Carpet & Upholstery Shampoo, Picosoap Carpet & Upholstery Spotter, Picosoap Carpet Cleaner, and Picosoap Carpet shampoos, Picosoap Carpet spot removers.

Further, the pico-product may include Picosoap Cleaning Products such as Picosoap Concrete Cleaner, Picosoap Concrete structure cleaners, Picosoap Crease Trap and Drain Cleaner, Picosoap Dishwasher and laundry detergents, Picosoap Disinfectants, Picosoap DustDown Dust Palliative, Picosoap Dustroy Anti-Allergen Spray, Picosoap Fabric softeners, Picosoap Fabric stain removers, Picosoap Fertilizer, Picosoap Filter cleaners, Picosoap Filter Wash, Picosoap Floor & Tile Cleaner, Picosoap Floor cleaning products, Picosoap Floor Polish, Picosoap Floor Pre-Spot, Picosoap Floor Stripper, Picosoap Floor, Vinyl, Tile Cleaner, Picosoap Fruit & Vegetable Wash, Picosoap Glass, fiberglass polishing agents, Picosoap Glass, Mirror Cleaner, Picosoap Glue, adhesive, paint removers, Picosoap Glycerin Bath Bar, Picosoap Graffiti Remover, Picosoap Grease Trap and Drain Cleaner, Picosoap Hand creams & lotions, Picosoap Hand Dishwashing Liquid, Picosoap Heavy Duty Hand cleaner, Picosoap HVAC cleaners, Picosoap Industrial parts washing fluids, Picosoap Ink removers, Picosoap Kitchen & bath cleaners, Picosoap Kitchen Exhaust & Hood Cleaner, Picosoap Laundry Detergent, Picosoap Laundry Pre-soak, Picosoap Laundry Stain Remover, Picosoap Lip balms, Picosoap Liquid Hand Cleaner, Picosoap Magic Pan Hand Dishwashing Liquid, Picosoap Marine hull & cargo hold cleaners, Picosoap Mastic removers, Picosoap Metal cleaners, Picosoap Mold & Mildew Cleaner, Picosoap Multi-Surface Cleaner, Picosoap Odor-Ex Cleaning Deodorizer, Picosoap Odor-Ex Odor Neutralizer, Picosoap Oil & grease emulsifiers, Picosoap Oven & Grill Cleaner, Picosoap Premium Laundry Detergent, Picosoap Printing equipment cleaners, Picosoap Reusable carburetor and parts cleaner, Picosoap Shampoo for Dogs & Cats, Picosoap Solvents & Cleaners, Picosoap Stainless Steel Cleaner, Picosoap Steel Bright Polish, Picosoap Textile and dyeing equipment cleaner, Picosoap Trap and drain cleaners, Picosoap Tub & tile cleaners, Picosoap Waterless hand cleaners, and Picosoap Wood, leather, vinyl cleaners.

Further, the pico-product may include Animal Farm Care such as

Picosoap Farm Care Abrasions, Picosoap Farm Care Abscesses

Picosoap Farm Care Aural Plaque v, Picosoap Farm Care Bacteria

Picosoap Farm Care bacterial infections, Picosoap Farm Care Barns

Picosoap Farm Care Bedding, Picosoap Farm Care Animal Care Bio-Films Flush Cleanse, Picosoap Farm Care Bumps, Picosoap Farm Care Car Wash, Picosoap Farm Care Wash reproduction stalls, Picosoap Farm Care Wash reproducton floors, Picosoap Farm Care Milking Room Cleaning Steps 1, 2 and 3, Not 4, Picosoap Farm Care Containers, Picosoap Farm Care Cracked Heel, Picosoap Farm Care Culicoides Hypersensitivity, Picosoap Farm Care Cuts, Picosoap Farm Care Dermantitis, Picosoap Farm Care Detangles, Picosoap Farm Care Dew Poisoning, Picosoap Farm Care Diseased Tissue, Picosoap Farm Care Eliminates rubbing out their tails, Picosoap Farm Care Scratches, Picosoap Farm Care Farrier work clothes, Picosoap Farm Care Flat sarcoids, Picosoap Farm Care Fly Mask, Picosoap Farm Care Fly Sheets, Picosoap Farm Care Foot Rot, Picosoap Farm Care Frog removal of diseased tissue, Picosoap Farm Care Frog Treatment, Picosoap Farm Care Fungal coat problems, Picosoap Farm Care fungal infections v, Picosoap Farm Care Fungus, Picosoap Farm Care Girth Rash, Picosoap Farm Care Grease Heel, Picosoap Farm Care Greasy Heel, Picosoap Farm Care Grooming Brushes, Picosoap Farm Care Hair growth promotion, Picosoap Farm Care Hair Wash Care, Picosoap Farm Care Horse Blankets, Picosoap Farm Care Horse Urine, Picosoap Farm Care Hotspots, Picosoap Farm Care Increased Hair Growth, Picosoap Farm Care Insect bites v, Picosoap Farm Care insect infestations v, Picosoap Farm Care Itchy Horse, Picosoap Farm Care Lacerations, Picosoap Farm Care Lice, Picosoap Farm Care Lumps, Picosoap Farm Care Mange, Picosoap Farm Care Mange demodectic, Picosoap Farm Care Mange scarcoptic, Picosoap Farm Care Mange, Picosoap Farm Care mosquitoes gnats flies Gnats No Seem Ums, Picosoap Farm Care Mud Fever, Picosoap Farm Care Mud Foot, Picosoap Farm Care Mutilating stop, Picosoap Farm Care Nicks, Picosoap Farm Care Pails, Picosoap Farm Care Parasites v, Picosoap Farm Care parasites removal v, Picosoap Farm Care Parasites, Picosoap Farm Care Penile Fibropapilloma, Picosoap Farm Care Pregnant mares nursing foils and weanlings, Picosoap Farm Care Pruritis, Picosoap Farm Care Pruritis elimination, Picosoap Farm Care Rain Rot v, Picosoap Farm Care Rain Scald v, Picosoap Farm Care Repel biting insects, Picosoap Farm Care Riding Pads, Picosoap Farm Care Rubbing out their tails, Picosoap Farm Care Sacriod flat tumors removal, Picosoap Farm Care Saddle Blankets, Picosoap Farm Care Saddle Pads, Picosoap Farm Care Sand bumps, Picosoap Farm Care Scabs and Swelling v, Picosoap Farm Care Scratches, Picosoap Farm Care Shampoo, Picosoap Farm Care Shines, Picosoap Farm Care Skin abrasions, Picosoap Farm Care Skin hives, Picosoap Farm Care Skin scurf, Picosoap Farm Care Sole bruising, Picosoap Farm Care Sole Callus, Picosoap Farm Care Sole removal of diseased tissue, Picosoap Farm Care Sole Treatment, Picosoap Farm Care Sore Healing, Picosoap Farm Care Stable Laundry Care For Reproduction, Picosoap Farm Care Stable Walls and Floor Wash, Picosoap Farm Care Stable Wash, Picosoap Farm Care Summer Itch, Picosoap Farm Care Sunburn relief, Picosoap Farm Care Swamp Fever, Picosoap Farm Care Thrush, Picosoap Farm Care Tractor Wash, Picosoap Farm Care Trailer Wash, Picosoap Farm Care Truck Wash, Picosoap Farm Care Ulcerating bumps, Picosoap Farm Care Warts, Picosoap Farm Care Washes, Picosoap Farm Care White line disease, Picosoap Farm Care wound healing, Picosoap Farm Care Wounds, and Picosoap Farm Care Yeast.

Further, the present disclosure describes the cleaning composition that may include an active element Carbanion which is 688 negatively charged. Further, the cleaning composition is used to prepare cleaning products. Further, the cleaning composition is prepared using 700 drops or 2 ounces (oz) of carbanions per gallon of water.

FIG. 1 is a table 100 listing ingredients of cleaning composition for facilitating cleaning surfaces of an object using femtotechnology, in accordance with some embodiments. Further, the table 100 may include a column 102 and two rows 104-106. Further, the table 100 may include two cells (column 102, row 104) and (column 102, row 106). Further, the cleaning composition may include carbanions and a diluting agent.

Further, a cell (column 102, row 104) of the table 100 may be related to the carbanions. Further, a carbanion of the carbanions may include a carbon atom. Further, the carbon atom may include a formal charge of −1.

Further, a cell (column 102, row 106) of the table 100 may be related to the diluting agent. Further, the diluting agent may be capable of combining with the carbanions for forming at least one appliable form of the cleaning composition. Further, a ratio of the diluting agent to the carbanions by volume may be 64:1. Further, 1 gallon of the diluting agent may be combined with 2 ounces (oz) of the carbanions based on the ratio of 64:1 for forming the cleaning composition. Further, the 2 ounces of the carbanions may include 700 drops of the carbanions. Further, 1 drop may include sextillion carbanions. Further, the combining facilitates applying of the at least one appliable form of the cleaning composition to at least one surface of the object. Further, the applying of the at least one appliable form of the cleaning composition cleans at least one contaminant present on the at least one surface of the object. Further, the at least one object may include a human body, an animal body, an item, an article, etc. Further, in an embodiment, the diluting agent and the carbanions may be combined in a plurality of volume ratios for forming at least 200 dilutions of the cleaning composition.

Further, in an embodiment, the at least one surface may be a skin of a body part of the human body. Further, the at least one contamination may include at least one infestation on the skin. Further, the applying of the at least one appliable form of the cleaning composition may heal the skin of the at least one infestation by removing the at least one infestation. Further, the at least one infestation may cause at least one disease.

Further, in some embodiments, each carbanion of the carbanions may be capable of creating an electromechanical reaction with at least one of an organic material and an inorganic material of the at least one contaminant present on the at least one surface of the object based on the applying of the at least one appliable form of the cleaning composition. Further, the creating of the electromechanical reaction disassembles at least one of the organic material and the inorganic material for cleaning the at least one surface of the object. Further, in an embodiment, the at least one contaminant may include at least one organism. Further, the at least one organism may include microorganisms, insects, pests, etc. Further, the microorganisms may include bacteria, fungi, viruses, protozoa, etc. Further, the at least one organism may be present on the at least one surface of the object. Further, the at least one organism may be comprised of at least one of the organic material and the inorganic material. Further, the creating of the electromechanical reaction disassemble at least one of the organic material and the inorganic material of the at least one organism for eliminating the at least one organism. Further, the eliminating of the at least one organism cleans the at least one surface of the object. In further embodiments, the cleaning composition may include at least one inhibiting agent for inhibiting at least one of a growth and a proliferation of the at least one organism on the at least one surface of the object based on the applying. Further, the inhibiting facilitates the cleaning of the at least one surface of the object.

In further embodiments, the cleaning composition may include at least one protective agent for forming a protective layer on the at least one surface based on the applying. Further, the forming of the protective layer prevents subsequent contaminating of the at least one surface of the object with the at least one contaminant. Further, the at least one protective agent may include a moisturizing agent, a soothing agent, etc. Further, the moisturizing agent may include mineral oils, organic oils, vegetable oils, animal oils, etc.

Further, in some embodiments, the carbanions may be derived from at least one organic material. Further, the at least one organic material may be associated with at least one part of at least one plant.

Further, in some embodiments, the carbon atom may be associated with a hybridization state. Further, the hybridization state may be sp3 hybridization state. Further, the carbon atom in the sp3 hybridization state may be trivalent. Further, the carbon atom in the sp3 hybridization state may include a lone pair of electrons on the carbon atom.

Further, in some embodiments, the diluting agent may include at least one a polar solvent and a nonpolar solvent. Further, the nonpolar solvent may include alcohols, ethers, etc. Further, at least one of the polar solvent and the nonpolar solvent may be capable of combining with the carbanions for forming the at least one appliable form. Further, in an embodiment, the polar solvent may include water. Further, the water may be capable of combining with the carbanions for forming a first solution. Further, the at least one appliable form may include the first solution. Further, the combining facilitates applying of the first solution of the cleaning composition to at least one surface of the object. Further, in an embodiment, the polar solvent may include at least one organic acid. Further, the at least one organic acid may include acetic acid, citric acid, etc. Further, the at least one organic acid may be capable of combining with the carbanions for forming a second solution. Further, the at least one appliable form may include the second solution. Further, the combining facilitates applying of the second solution of the cleaning composition to at least one surface of the object.

Further, in some embodiments, the carbanion may include negatively charged carbon atoms. Further, the negatively charged carbon atoms may not be active ingredients. Further, the negatively charged carbon atoms may attract positive atoms and release the vital fluid from at least one of fungi, bacteria, viruses, and insects causing the elimination of at least one of the fungi, the bacteria, the viruses, and the insects. Further, the at least one organism may include at least one of the fungi, the bacteria, the viruses, and the insects. Further, the negatively charged carbon atoms may make surfaces of the pests positively charged by knocking electrons out from the surface of pests.

Further, in some embodiments, the carbanions may forms particles in the solution. Further, the particles may be associated with a particle size. Further, the particle size may be less than 1 nanometer in a straight solution. Further, in an instance, the particle size may be 0.6 nm or 600 pm. Further, the carbanions may include micelles structures. Further, the micelles structure may include a spherical shape. Further, most micelles may be 0.6 nm in particle size hydrodynamic radius.

Further, in some embodiment, the carbanion of the carbanions may include a single negatively charged carbon atom. Further, the single negatively charged carbon atom bond to no other atoms except for another single negatively charged carbon atom.

Further, the carbanion may include "Negative Octet Energy". Further, the carbanion may be an anion in which the carbon-atom bears a formal negative charge.

Figure 2:
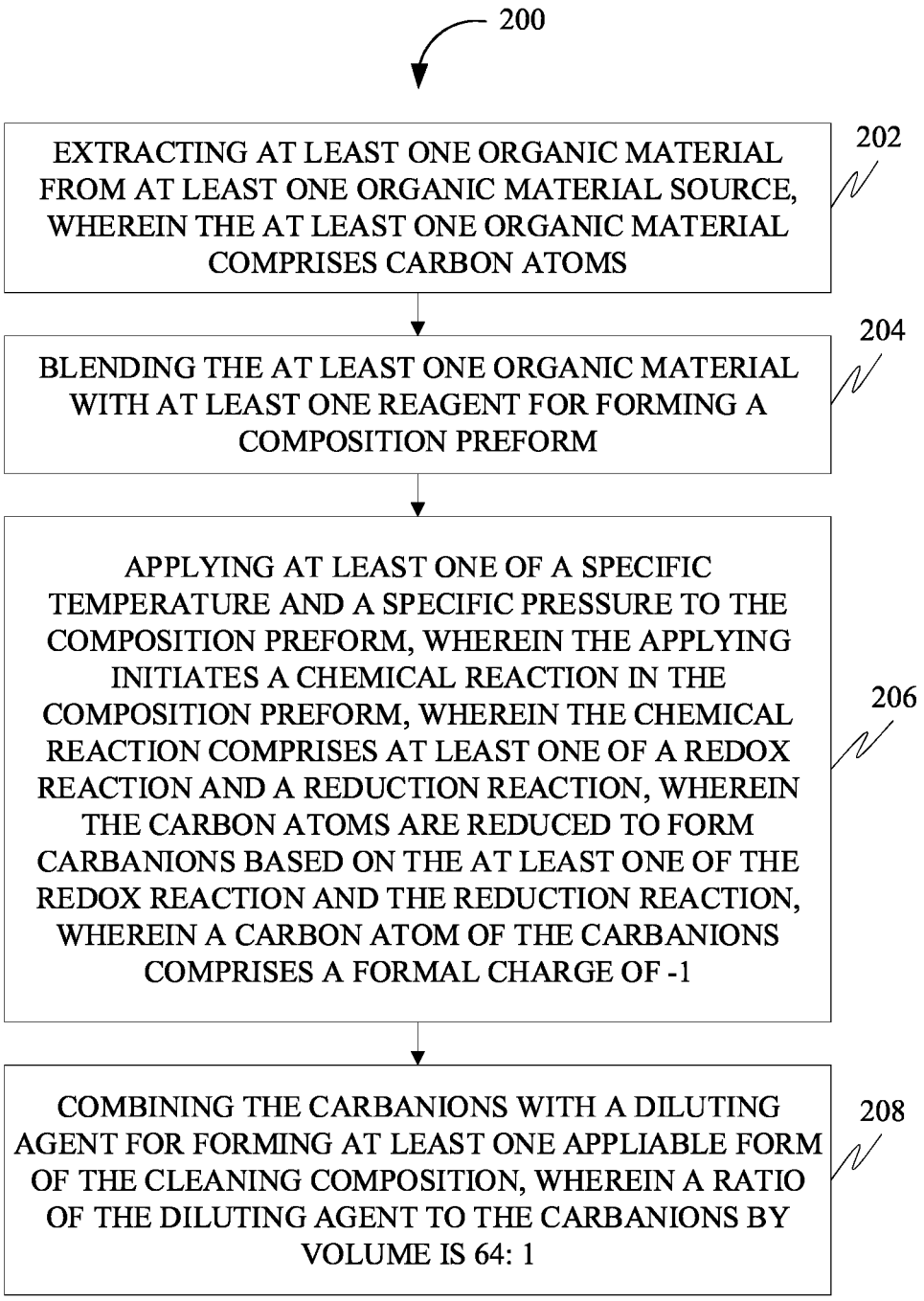
FIG. 2 is a flowchart of a method for producing a cleaning composition to facilitate cleaning surfaces of an object, in accordance with some embodiments.

FIG. 2 is a flowchart of a method 200 for producing a cleaning composition to facilitate cleaning surfaces of an object, in accordance with some embodiments. Further, at 202, the method 200 may include a step of extracting at least one organic material from at least one organic material source. Further, the at least one organic material source may include at least one plant. Further, the at least one organic material may be 100% biomass. Further, the at least one organic material may include carbon atoms. Further, the carbon atoms may be organic carbon atoms.

Further, at 204, the method 200 may include a step of blending the at least one organic material with at least one reagent for forming a composition preform. Further, the at least one reagent may include a reducing agent.

Further, at 206, the method 200 may include a step of applying at least one of a specific temperature and a specific pressure to the composition preform. Further, the applying initiates a chemical reaction in the composition preform. Further, the chemical reaction may include at least one of a redox reaction and a reduction reaction. Further, the carbon atoms may be reduced to form carbanions based on the at least one of the redox reaction and the reduction reaction. Further, a carbon atom of the carbanions may include a formal charge of −1.

Further, at 208, the method 200 may include a step of combining the carbanions with a diluting agent for forming at least one appliable form of the cleaning composition.

Further, a ratio of the diluting agent to the carbanions by volume may be 64:1. Further, the combining facilitates applying of the at least one appliable form of the cleaning composition to at least one surface of the object. Further, the applying of the at least one appliable form of the cleaning composition cleans at least one contaminant present on the at least one surface of the object.

Further, in some embodiments, each carbanion of the carbanions may be capable of creating an electromechanical reaction with at least one of an organic material and an inorganic material of the at least one contaminant present on the at least one surface of the object based on the applying of the at least one appliable form of the cleaning composition. Further, the creating of the electromechanical reaction disassembles at least one of the organic material and the inorganic material for cleaning the at least one surface of the object. Further, in an embodiment, the at least one contaminant may include at least one organism. Further, the at least one organism may be present on the at least one surface of the object. Further, the at least one organism may be comprised of at least one of the organic material and the inorganic material. Further, the creating of the electromechanical reaction disassemble at least one of the organic material and the inorganic material of the at least one organism for eliminating the at least one organism. Further, the eliminating of the at least one organism cleans of the at least one surface of the object. In further embodiments, the method 200 may include adding at least one inhibiting agent to the carbanions. Further, the combining of the carbanions with the diluting agent may be based on the adding of the at least one inhibiting agent. Further, the at least one inhibiting agent inhibits at least one of a growth and a proliferation of the at least one organism on the at least one surface of the object based on the applying. Further, inhibiting facilitates the cleaning of the at least one surface of the object. Further, the at least one inhibiting agent creates a hostile environment for the at least one organism.

In further embodiments, the method 200 may include adding at least one protective agent to the carbanions. Further, the combining of the carbanions with the diluting agent may be based on the adding of the at least one protective agent. Further, the at least one protective agent forms a protective layer on the at least one surface based on the applying. Further, forming of the protective layer prevents subsequent contaminating of the at least one surface of the object with the at least one contaminant Further, in some embodiments, the carbanions may be derived from at least one organic material. Further, the at least one organic material may be associated with at least one part of at least one plant.

Further, in some embodiments, the carbon atom may be associated with a hybridization state. Further, the hybridization state may be sp3 hybridization state. Further, the carbon atom in the sp3 hybridization state may be trivalent. Further, the carbon atom in the sp3 hybridization state may include a lone pair of electrons on the carbon atom.

Further, in some embodiments, the diluting agent may include at least one a polar solvent and a nonpolar solvent. Further, at least one of the polar solvent and the nonpolar solvent may be capable of combining with the carbanions for forming the at least one appliable form. Further, in an embodiment, the polar solvent may include water. Further, the water may be capable of combining with the carbanions for forming a first solution. Further, the at least one appliable form may include the first solution. Further, the combining facilitates applying of the first solution of the cleaning composition to at least one surface of the object. Further, in an embodiment, the polar solvent may include at least one organic acid. Further, the at least one organic acid may be capable of combining with the carbanions for forming a second solution. Further, the at least one appliable form may include the second solution. Further, the combining facilitates applying of the second solution of the cleaning composition to at least one surface of the object.

Figure 3:
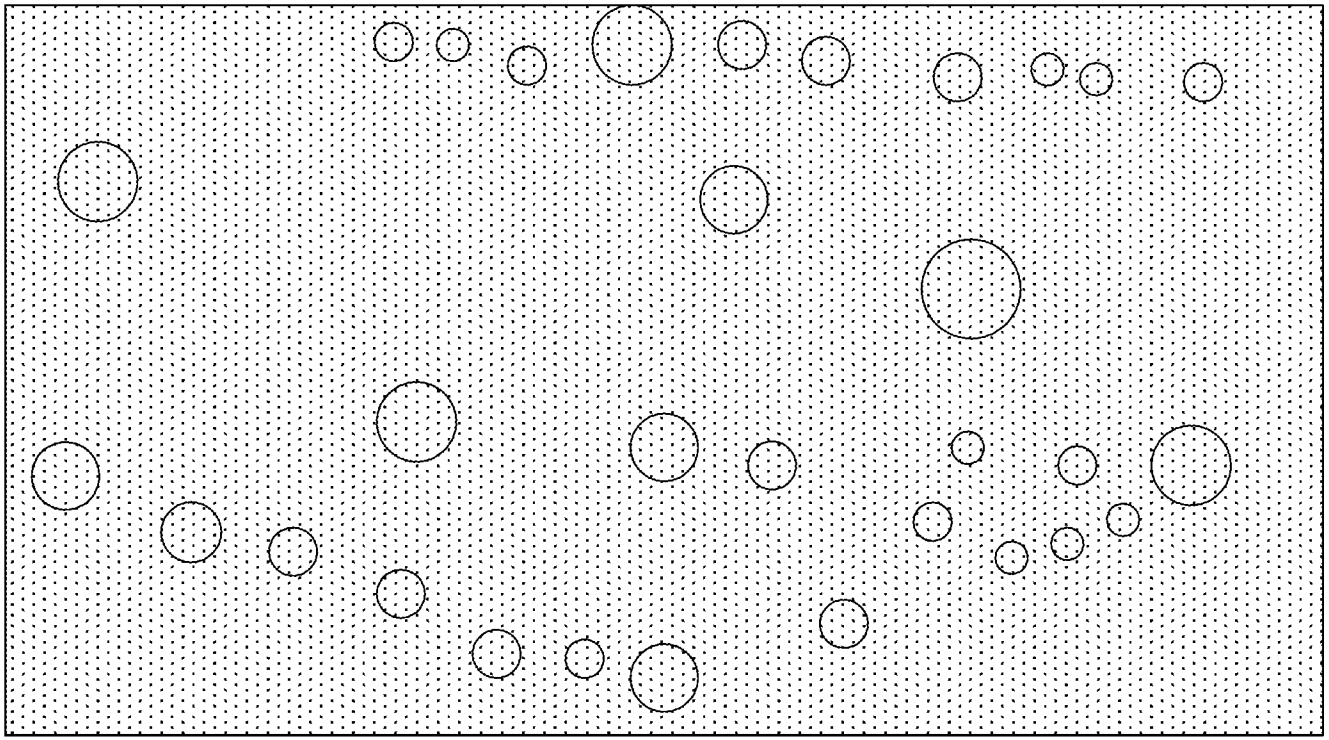
FIG. 3 illustrates carbanions of the cleaning composition for facilitating cleaning surfaces of the object, in accordance with some embodiments.

FIG. 3 illustrates carbanions of the cleaning composition for facilitating cleaning surfaces of the object, in accordance with some embodiments. Further, the carbanions may be configured for performing at least one cleaning action on at least one object. Further, the carbanions may be configured for at least one of neutralizing and removing at least one of at least one substance and at least one organism from the at least one object based on the at least one cleaning action. Further, the at least one of the at least one substance and the at least one organism contaminates the at least one object. Further, the at least one of the at least one substance and the at least one organism pollutes the at least one object. Further, the at least one of the at least one substance and the at least one organism infects the at least one object. Further, the at least one of the at least one substance and the at least one organism stains the at least one object. Further, the at least one organism may include fungi, bacteria, viruses, insects, etc. Further, the insects may include pests, parasites, etc. Further, the carbanions may be configured for performing the at least one cleaning action on at least one surface of the at least one object. Further, the at least one object may include at least one animate object and at least one inanimate object. Further, the at least one inanimate object may include at least one building, at least one article, at least one device, etc. Further, the at least one animate object at least one human, at least one animal, at least one plant, etc. Further, the at least one animal may include at least one domestic animal, at least one farm animal, at least one wild animal, etc. Further, the at least one cleaning action may include removing, washing, eliminating, killing, disinfecting, sanitizing, etc. Further, the carbanions may be derived from at least one organic source. Further, the at least one organic source may include the at least one plant. Further, the carbanions may include carbon atoms extracted from the at least one plant. Further, the carbanion may include a 100% organic matter. Further, the organic matter may be organic carbon atoms. Further, at least one of a specific temperature and a specific pressure may be applied to the carbon atoms for initiating at least one of a reduction reaction and a redox reaction. Further, the at least one of the reduction reaction and the redox reaction adds 2 electrons to the carbon atoms for creating negatively charged carbon atoms. Further, each negatively charged carbon atom of the negatively charged carbon atoms may include 8 electrons and 6 protons and 6 neutrons. Further, the negatively charged carbon atoms may be highly negatively charged. Further, the negatively charged carbon atoms may be the carbanions. Further, the carbanions may include a trivalent carbon atom comprising eight (8) electrons in the valence shell of the trivalent carbon atom. Further, the carbanions may be created using physical chemistry of the carbanions. Further, the negatively charged carbon atoms may be configured for removing the at least one substance from the at least one object. Further, the negatively charged carbon atoms may be configured for puncturing the membranes of at least one of the fungi, the bacteria, the viruses, and the insects for eliminating the at least one of the fungi, the bacteria, the viruses, and the insects. Further, the puncturing may release vital fluid of the at least one of the fungi, the bacteria, the viruses, and the insects for the eliminating of the at least one of the fungi, the bacteria, the viruses, and the insects.

Further, in some embodiments, the at least one organic source may include biomass. Further, the carbanions may be bio-based.

Further, in some embodiments, the carbanions may be diluted using at least one diluting agent for forming a solution. Further, the at least one diluting agent may include water. Further, at least one dosage of the carbanions may be diluted with at least one diluting volume of the at least one diluting agent. Further, the solution may be configured for performing the at least one cleaning action. Further, in an embodiment, 700 drops of the carbanions may be diluted with 1 gallon of the water for forming the solution. Further, the 700 drops may be 2 oz. of the carbanions.

Further, in an embodiment, the negatively charged carbon atoms may attract positive atoms and release the vital fluid from the at least one of the fungi, bacteria, viruses, and insects for eliminating the at least one of the fungi, bacteria, viruses, and insects.

Further, in some embodiments, the negatively charged carbon atoms may include particles. Further, the particles may be associated with particle size. Further, the particle size may be less than 1 nanometer in a straight solution. Further, in an instance, the particle size may be 0.6 nm or 600 pm.

Further, in some embodiments, the carbanions may include a pico-product. Further, the pico-product 100% organic matter. Further, the organic matter may include organic carbon atoms. Further, the pico-product may be 89% New Carbon. Further, a new carbon atom may be 100% organic. Further, the pico-product may kill the viruses by eliminating strands of nucleic acids of the viruses, either DNA or RNA of the viruses, and protective protein coat of the viruses (the capsid), or a lipid envelope of the viruses surrounding the protein of the viruses.

Further, in an embodiment, a carbanion of the carbanions may include a single negatively charged carbon atom. Further, the single negatively charged carbon atom bonds to no other atoms except for another single negatively charged carbon atom.

Further, in an embodiment, the carbanion may be an anion in which carbon bears a formal negative charge. Further, the carbanion may include eight electrons in the valence shell of the carbon. Further, a carbon-atom of the carbanion may include a negative charge. Further, the valence shell of a negatively charged carbon-atom may include 8-electrons. Further, the octet of the negatively charged carbon atom may be complete. Further, the negatively charged carbon atom may include an extra pair of electrons. Further, the negatively charged carbon may be in a state of sp3 hybridization. Further, the hybrid orbitals may be directed towards the corners of a tetrahedron. Further, three hybrid orbitals may be involved in the formation of single covalent bonds with other atoms while the fourth hybrid orbital may include a lone pair of electron. Further, the carbanion may include a pyramidal structure similar to NH3 molecule. Further, the carbon-atom may include eight electrons. Further, the carbon-atom may be a highly reactive intermediate. Further, the carbon-atom may be readily attacked by electrophilic reagents. Further, the carbanion may be a nucleophile.

Further, in some embodiments, the carbanions may be diluted using at least one diluting agent for forming a solution. Further, the at least one diluting agent may include water. Further, at least one dosage of the carbanions may be diluted with at least one diluting volume of the at least one diluting agent. Further, the solution may be configured for performing the at least one cleaning action. Further, in an embodiment, 700 drops of the carbanions may be diluted with 1 gallon of the water for forming the solution. Further, the 700 drops may be 2 oz. of the carbanions.

Further, the carbanion may include "Negative Octet Energy". Further, the carbanion may be an anion in which the carbon-atom bears a formal negative charge.

Figure 4:
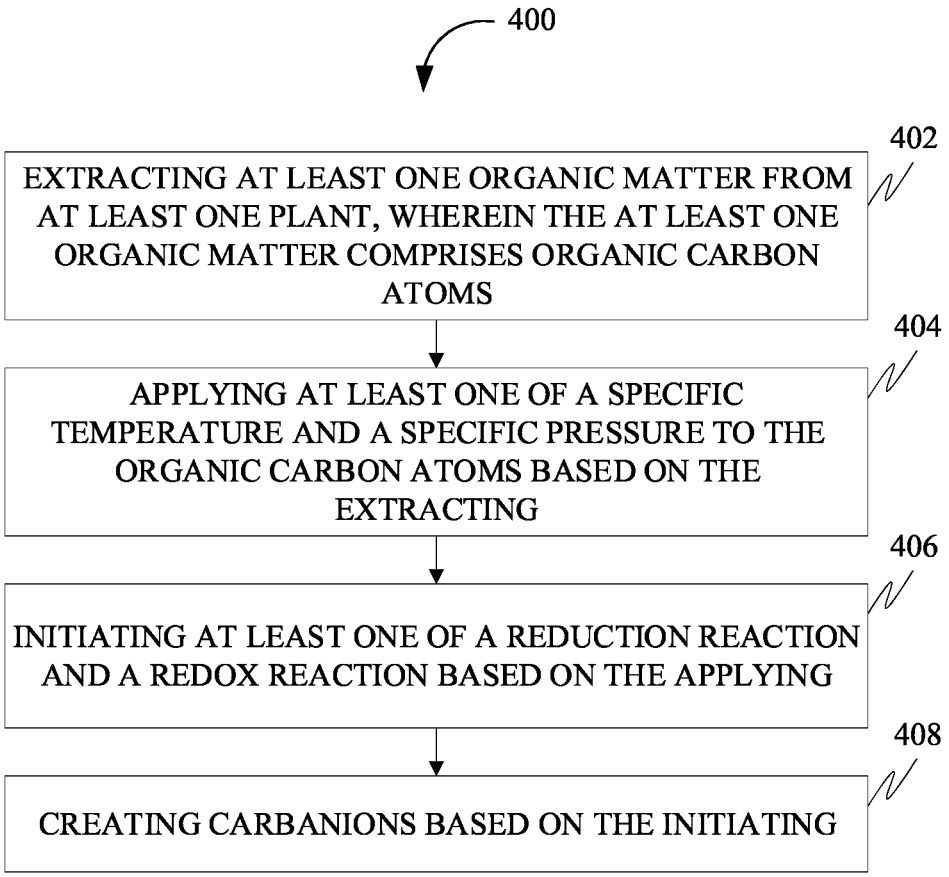
FIG. 4 is a flowchart of a process for producing the carbanions of the cleaning composition for facilitating cleaning of the object, in accordance with some embodiments.

FIG. 4 is a flowchart of a process 400 for producing the carbanions of the cleaning composition for facilitating cleaning of the object, in accordance with some embodiments. Further, at 402, the process 400 may include a step of extracting at least one organic matter from at least one plant. Further, the at least one organic matter may include organic carbon atoms.

Further, at 404, the process 400 may include a step of applying at least one of a specific temperature and a specific pressure to the organic carbon atoms based on the extracting.

Further, at 406, the process 400 may include a step of initiating at least one of a reduction reaction and a redox reaction based on the applying.

Further, at 408, the process 400 may include a step of creating the carbanions based on the initiating. Further, the initiating of the at least one of the reduction reaction and the redox reaction may add 2 electrons to the organic carbon atoms creating negatively charged carbon atoms.

Figure 5:
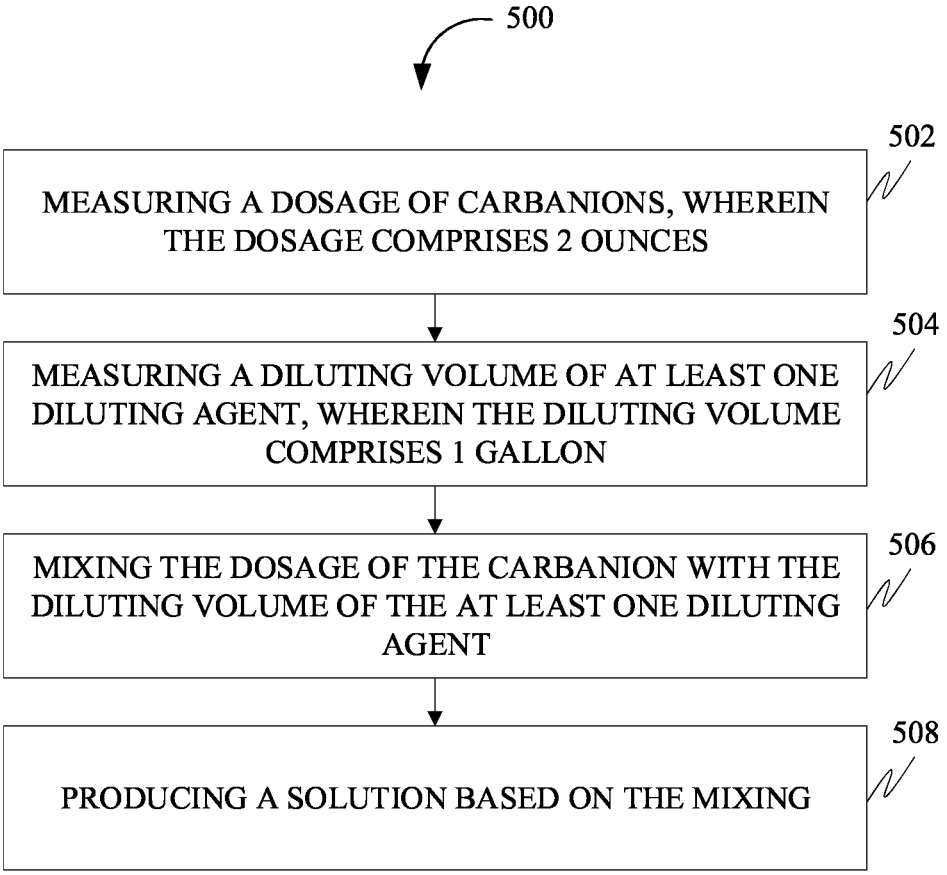
FIG. 5 is a flowchart of a process for producing a solution of the cleaning composition, in accordance with some embodiments.

FIG. 5 is a flowchart of a process 500 for producing a solution of the cleaning composition, in accordance with some embodiments. Further, at 502, the process 500 may include a step of measuring a dosage of the carbanions. Further, the dosage may include 2 ounces. Further, the 2 ounces of the carbanion may include 700 drops of the carbanions.

Further, at 504, the process 500 may include measuring a diluting volume of at least one diluting agent. Further, the diluting volume may include 1 gallon. Further, the at least one diluting agent may include water.

Further, at 506, the process 500 may include a step of mixing the dosage of the carbanion with the diluting volume of the at least one diluting agent.

Further, at 508, the process 500 may include a step of producing the solution based on the mixing. Further, the solution may be configured for performing at least one cleaning action on at least one object.

Figure 6:
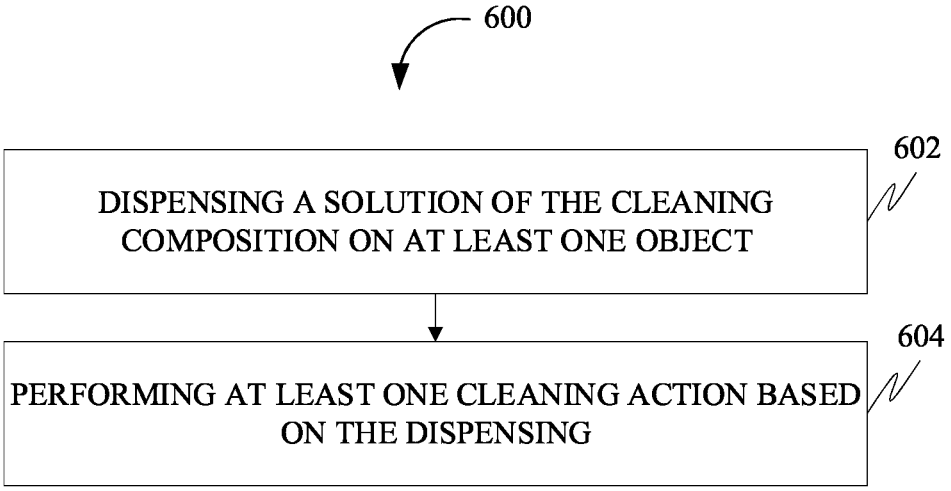
FIG. 6 is a flowchart of a process for facilitating cleaning of the object using the cleaning composition, in accordance with some embodiments.

FIG. 6 is a flowchart of a process 600 for facilitating cleaning of the object using the cleaning composition, in accordance with some embodiments. Further, at 602, the process 600 may include a step of dispensing a solution of the cleaning composition on at least one object. Further, the at least one object may include at least one animate object and at least one inanimate object. Further, the solution may include the carbanions and at least one diluting agent. Further, the at least one diluting agent may include water.

Further, at 602 the process 604 may include a step of performing at least one cleaning action based on the dispensing. Further, the solution may be configured for at least one of neutralizing and removing at least one of at least one substance and at least one organism from the at least one object.

Figure 7:
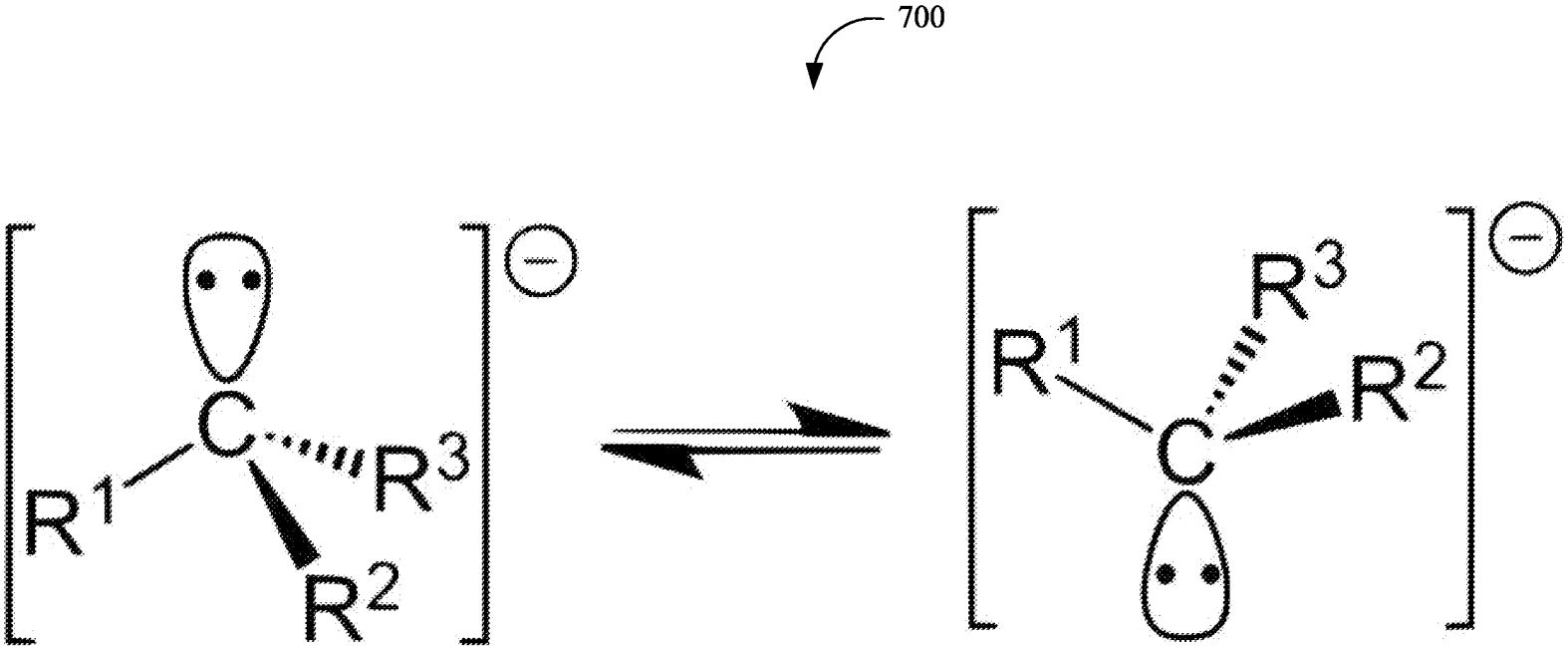
FIG. 7 is a schematic of a carbanion of the carbanions, in accordance with some embodiments.

FIG. 7 is a schematic of a carbanion 700 of the carbanions, in accordance with some embodiments. Further, the carbanion 700 is an anion in which carbon bears a formal negative charge. Further, the carbanion 700 may include eight electrons in the valence shell of the carbon. Further, a carbon-atom of the carbanion 700 may include a negative charge. Further, the valence shell of negatively charged carbon-atom may include 8-electrons. Further, the octet of the negatively charged carbon atom may be complete.

Further, the negatively charged carbon atom may include an extra pair of electrons. Further, the negatively charged carbon may be in a state of sp3 hybridization. Further, the hybrid orbitals may be directed towards the corners of a tetrahedron. Further, three of the hybrid orbitals may be involved in the formation of single covalent bonds with other atoms while the fourth hybrid orbital may include a lone pair of electrons. Further, the carbanion 700 may include a pyramidal structure similar to NH3 molecule. Further, the carbon-atom may include eight electrons even the carbon-atom may be a highly reactive intermediate. Further, the carbon-atom may be readily attacked by electrophilic reagents. Further, the carbanion 700 may be a nucleophile.

Although the present disclosure has been explained in relation to its preferred embodiment, it is to be understood that many other possible modifications and variations can be made without departing from the spirit and scope of the disclosure.

What is claimed is:

1. A cleaning composition for facilitating cleaning surfaces of an object, the cleaning composition comprising:

carbanions, wherein a carbanion of the carbanions comprises a carbon atom, wherein the carbon atom comprises a formal charge of −1; and a diluting agent, wherein the diluting agent is capable of combining with the carbanions for forming at least one appliable form of the cleaning composition, wherein a ratio of the diluting agent to the carbanions by volume is 64:1, wherein the combining facilitates applying of the at least one appliable form of the cleaning composition to at least one surface of the object, wherein the applying of the at least one appliable form of the cleaning composition cleans at least one contaminant present on the at least one surface of the object.

2. The cleaning composition of claim 1, wherein each carbanion of the carbanions is capable of creating an electromechanical reaction with at least one of an organic material and an inorganic material of the at least one contaminant present on the at least one surface of the object based on the applying of the at least one appliable form of the cleaning composition, wherein the creating of the electromechanical reaction disassembles at least one of the organic material and the inorganic material for cleaning the at least one surface of the object.

3. The cleaning composition of claim 2, wherein the at least one contaminant comprises at least one organism, wherein the at least one organism is present on the at least one surface of the object, wherein the at least one organism is comprised of at least one of the organic material and the inorganic material, wherein the creating of the electromechanical reaction disassemble at least one of the organic material and the inorganic material of the at least one organism for eliminating the at least one organism, wherein the eliminating of the at least one organism cleans the at least one surface of the object.

4. The cleaning composition of claim 3 further comprising at least one inhibiting agent for inhibiting at least one of a growth and a proliferation of the at least one organism on the at least one surface of the object based on the applying, wherein the inhibiting facilitates the cleaning of the at least one surface of the object.

5. The cleaning composition of claim 1 further comprising at least one protective agent for forming a protective layer on the at least one surface based on the applying, wherein the forming of the protective layer prevents subsequent contaminating of the at least one surface of the object with the at least one contaminant.

6. The cleaning composition of claim 1, wherein the carbanions are derived from at least one organic material, wherein the at least one organic material is associated with at least one part of at least one plant.

7. The cleaning composition of claim 1, wherein the carbon atom is associated with a hybridization state, wherein the hybridization state is sp3 hybridization state, wherein the carbon atom in the sp3 hybridization state is trivalent, wherein the carbon atom in the sp3 hybridization state comprises a lone pair of electrons on the carbon atom.

8. The cleaning composition of claim 1, wherein the diluting agent comprises at least one a polar solvent and a nonpolar solvent, wherein at least one of the polar solvent and the nonpolar solvent is capable of combining with the carbanions for forming the at least one appliable form.

9. The cleaning composition of claim 8, wherein the polar solvent comprises water, wherein the water is capable of combining with the carbanions for forming a first solution, wherein the at least one appliable form comprises the first solution, wherein the combining facilitates applying of the first solution of the cleaning composition to at least one surface of the object.

10. The cleaning composition of claim 8, wherein the polar solvent comprises at least one organic acid, wherein the at least one organic acid is capable of combining with the carbanions for forming a second solution, wherein the at least one appliable form comprises the second solution, wherein the combining facilitates applying of the second solution of the cleaning composition to at least one surface of the object.

11. A method for producing a cleaning composition to facilitate cleaning surfaces of an object, the method comprising:

extracting at least one organic material from at least one organic material source, wherein the at least one organic material comprises carbon atoms;

blending the at least one organic material with at least one reagent for forming a composition preform;

applying at least one of a specific temperature and a specific pressure to the composition preform, wherein the applying initiates a chemical reaction in the composition preform, wherein the chemical reaction comprises at least one of a redox reaction and a reduction reaction, wherein the carbon atoms are reduced to form carbanions based on the at least one of the redox reaction and the reduction reaction, wherein a carbon atom of the carbanions comprises a formal charge of −1; and combining the carbanions with a diluting agent for forming at least one appliable form of the cleaning composition, wherein a ratio of the diluting agent to the carbanions by volume is 64:1, wherein the combining facilitates applying of the at least one appliable form of the cleaning composition to at least one surface of the object, wherein the applying of the at least one appliable form of the cleaning composition cleans at least one contaminant present on the at least one surface of the object.

12. The cleaning composition of claim 11, wherein each carbanion of the carbanions is capable of creating an electromechanical reaction with at least one of an organic material and an inorganic material of the at least one contaminant present on the at least one surface of the object based on the applying of the at least one appliable form of the cleaning composition, wherein the creating of the electromechanical reaction disassembles at least one of the organic material and the inorganic material for cleaning the at least one surface of the object.

13. The cleaning composition of claim 12, wherein the at least one contaminant comprises at least one organism, wherein the at least one organism is present on the at least one surface of the object, wherein the at least one organism is comprised of at least one of the organic material and the inorganic material, wherein the creating of the electromechanical reaction disassemble at least one of the organic material and the inorganic material of the at least one organism for eliminating the at least one organism, wherein the eliminating of the at least one organism cleans of the at least one surface of the object.

14. The cleaning composition of claim 13 further comprising adding at least one inhibiting agent to the carbanions, wherein the combining of the carbanions with the diluting agent is further based on the adding of the at least one inhibiting agent, wherein the at least one inhibiting agent inhibits at least one of a growth and a proliferation of the at least one organism on the at least one surface of the object based on the applying, wherein inhibiting facilitates the cleaning of the at least one surface of the object.

15. The cleaning composition of claim 11 further comprising adding at least one protective agent to the carbanions, wherein the combining of the carbanions with the diluting agent is further based on the adding of the at least one protective agent, wherein the at least one protective agent forms a protective layer on the at least one surface based on the applying, wherein forming of the protective layer prevents subsequent contaminating of the at least one surface of the object with the at least one contaminant.

16. The cleaning composition of claim 11, wherein the carbanions are derived from at least one organic material, wherein the at least one organic material is associated with at least one part of at least one plant.

17. The cleaning composition of claim 11, wherein the carbon atom is associated with a hybridization state, wherein the hybridization state is sp3 hybridization state, wherein the carbon atom in the sp3 hybridization state is trivalent, wherein the carbon atom in the sp3 hybridization state comprises a lone pair of electrons on the carbon atom.

18. The cleaning composition of claim 11, wherein the diluting agent comprises at least one a polar solvent and a nonpolar solvent, wherein at least one of the polar solvent and the nonpolar solvent is capable of combining with the carbanions for forming the at least one appliable form.

19. The cleaning composition of claim 18, wherein the polar solvent comprises water, wherein the water is capable of combining with the carbanions for forming a first solution, wherein the at least one appliable form comprises the first solution, wherein the combining facilitates applying of the first solution of the cleaning composition to at least one surface of the object.

20. The cleaning composition of claim 18, wherein the polar solvent comprises at least one organic acid, wherein the at least one organic acid is capable of combining with the carbanions for forming a second solution, wherein the at least one appliable form comprises the second solution, wherein the combining facilitates applying of the second solution of the cleaning composition to at least one surface of the object.

* * * * *